United States Patent [19]

Southard

[11] 4,309,967

[45] Jan. 12, 1982

[54] VARIATION OF ENGINE COOLANT HEATER

[76] Inventor: Edward S. Southard, 1101 W. Pine St., Lodi, Calif. 95240

[21] Appl. No.: 111,345

[22] Filed: Jan. 11, 1980

[51] Int. Cl.[3] ..... F02N 17/06

[52] U.S. Cl. ..... 123/179 H; 123/142.5 R; 123/550; 123/556

[58] Field of Search ..... 123/142.5 R, 179 H, 123/550, 551, 556; 122/136 R

[56] References Cited

U.S. PATENT DOCUMENTS

| | | | |
|---|---|---|---|
| 2,400,838 | 5/1946 | Olson | 219/38 |
| 3,157,773 | 11/1964 | Pickard | 219/205 |
| 3,171,016 | 2/1965 | Sukala | 219/208 |
| 3,236,220 | 2/1966 | Holmes | 123/142.5 R |
| 3,400,700 | 9/1968 | Lindsey et al. | 123/142.5 R |
| 3,527,260 | 9/1970 | Kimmel | 122/136 R |
| 3,587,548 | 6/1971 | Wernicke | 123/142.5 |
| 3,626,148 | 12/1971 | Woytowich et al. | 219/208 |
| 3,758,031 | 9/1973 | Moran | 123/142.5 R |
| 3,766,356 | 10/1973 | Feldmann | 219/208 |
| 3,802,397 | 4/1974 | Wariner | 122/136 R |
| 3,943,325 | 3/1976 | Pickard | 219/208 |
| 3,949,723 | 4/1976 | Beesch | 123/179 H |
| 4,027,642 | 6/1977 | Kamada et al. | 123/179 H |
| 4,192,274 | 3/1980 | Damon | 123/142.5 R |

*Primary Examiner*—Charles J. Myhre
*Assistant Examiner*—Andrew M. Dolinar
*Attorney, Agent, or Firm*—Blair, Brown & Kreten

[57] ABSTRACT

A heater for the liquid coolant in an internal combustion engine which includes a tank connected to the engine block for the circulation of engine coolant, the tank having an enclosure within its interior in sealed, heat transfer relationship with the liquid coolant in the tank and outside air is introduced into the enclosure and heated by a burner for subsequent discharge from the enclosure in a heated condition. After the transfer of heat to the liquid coolant, the heated air discharged from the enclosure is conducted to the intake manifold for heating the manifold system prior to engine starting.

8 Claims, 4 Drawing Figures

VARIATION OF ENGINE COOLANT HEATER

BACKGROUND OF THE INVENTION

A problem that has confronted the operators of motor vehicles such as trucks and stationary equipment or the like having internal combustion engines and in particular diesel engines is the problem of cold weather starting. It is well known that in very cold or sub-zero weather, engine oil tends to solidify and batteries are very inefficient. Thus, the starting of engines in low temperature weather is not only a prolonged operation but also causes excessive wear on batteries, starting motors and the like. Furthermore, as the engine oil is quite viscous at low temperature, proper circulation of the oil is not obtained during engine starting so that inadequate lubrication of the engine during starting results in wear and tear on the engine parts. It is well known that equipment operators who must periodically stop for rest and sustenance attempt to avoid the problems of cold starting their diesel engines in their equipment by leaving the engine running during such periods which may last from some minutes to many hours, especially if such running is overnight. Consequently, considerable fuel is consumed during such idling operation of the engine not only adding considerably to the cost of operating the equipment but also producing pollutants which can be both annoying and destructive. Some attempt has been made to alleviate the problem of cold starting by the use of heaters inserted into the engine block such as immersion-type electric water heaters. However, such heaters require an electric outlet for each engine idle at any one given location and electric heaters are useless during power failures, or in rural areas where electric power is rare or non-existent.

OBJECTS AND SUMMARY OF THE INVENTION

Accordingly, a primary object of this invention is to provide a new and novel heater for internal combustion engines such as diesel engines for improved cold weather starting of such engines.

Another object of this invention is to provide a new and novel heater for an internal combustion engine which heats both the engine coolant and the intake manifold system of the engine so as to provide quick and easy engine starting.

A further object of this invention is to provide a new and novel heater for the coolant in liquid cooled internal combustion engines which does not require an electric power source and which is extremely simple and inexpensive in construction.

A further object of this invention is to provide a new and novel heater for an internal combustion engine which utilizes a minimum of readily available fuels such as liquified propane gas to heat both the engine block and the intake manifold of the engine so as to facilitate cold weather starting of the engine and which permits a substantial saving of engine fuel with the concomitant elimination of pollution.

Still another object of this invention is to provide a new and novel heater for the intake manifold and block in a liquid cooled internal combustion engine which may be easily installed in a vehicle such as a truck, construction equipment, farm machinery and the like with the minimum of effort, which is extremely inexpensive to operate and which operates virtually without fail to provide engine cold weather starting regardless of the low temperature weather conditions.

The invention will be better understood as well as further objects and advantages become apparent from the ensuing detailed description of the preferred embodiment taken in conjunction with the drawing.

DESCRIPTION OF THE PREFERRED EMBODIMENT

Figures 1, 2, 3, 4:
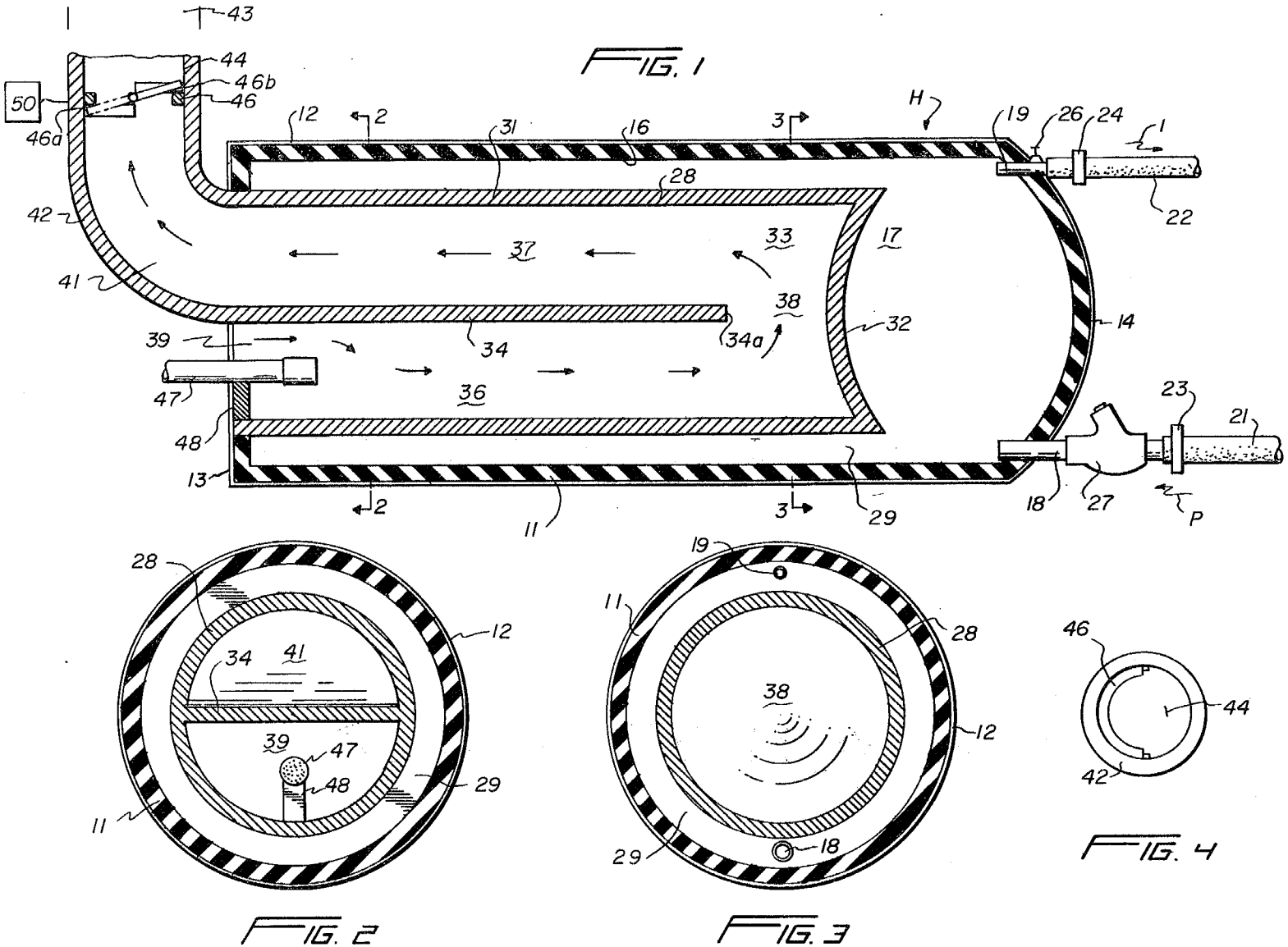
FIG. 1 is a longitudinal sectional view of the heater of the invention.
FIG. 2 is a sectional view taken substantially along line 2—2 of FIG. 1 in the direction of the arrow.
FIG. 3 is a sectional view taken substantially along line 3 of FIG. 1 in the direction of the arrows.
FIG. 4 is a plan view of a portion of the heater of the invention.

Referring now to the drawing and to FIG. 1 in particular there is shown a heater for an internal combustion engine (not shown) constructed in accordance with the invention and designated generally by the letter H. The heater H of the invention is adapted for heating the liquid coolant in the block of the internal combustion engine and also the intake manifold of the engine as will be explained hereinafter for cold weather starting of the engine under low temperature weather conditions.

The heater H includes a tank 11 preferably of circular cross-sectional shape as shown in FIG. 2 which is arranged to be suitably installed in the equipment provided with such a internal combustion engine in a convenient location remote from the equipment fuel tank. The tank 11 includes an outer wall of metal such as steel or the like comprising a side wall 12 and a pair of oppositely disposed end walls 13, 14. In the preferred embodiment, the tank is lined throughout with a layer of insulating material 16 and the tank 11 is provided with an interior 17. The tank 11 is provided with a liquid inlet 18 and a liquid outlet 19 the form of a short tube or the like each communicating at one end with the tank interior 17. The inlet and outlet 18, 19 respectively are preferably positioned within the tank end wall 14 in diametrically opposed relationship as shown and the flow cross section of the outlet 19 is somewhat smaller than the flow cross section of the inlet 18. Conduit means are provided for communicating the fluid inlet and outlet 18, 19 with the engine block (not shown) of the internal combustion engine which, in the preferred embodiment include hoses 21, 22 suitably secured by means of hose clamps 23, 24 to the liquid inlet and outlet 18, 19 respectively. Thus, the liquid coolant in the block is arranged to circulate between the engine block and the tank interior 17 flowing out of the tank 11 in the direction I of the arrow through the hose 22 and back into the tank from the engine block through the hose 21 in the direction of the arrow P. Preferably, an air bleed valve 26 is provided in the liquid outlet 19. Also, a check valve 27 is preferably provided in the liquid inlet 18 to prevent the flow of liquid coolant out of the tank interior 17 through the hose 21 opposite the direction of the arrow P.

The heater H also includes an enclosure 28 also preferably of circular cross-sectional shape which is disposed within the tank interior 17 in sealed relationship therewith and defining with the tank 11 a chamber 29 substantially surrounding the enclosure 28 in heat transfer relationship therewith. The enclosure 28 includes a side wall 31 and an end wall 32, the enclosure 28 being supported in a coaxial position relative to the tank 11 on the end wall 13 of the tank 11.

The enclosure 28 includes an interior 33 in which is disposed a baffle 34 preferably of substantially planar shape and extending diametrically within the interior 33 of the enclosure 28 as shown best in FIG. 2 to divide the enclosure interior 33 into a pair substantially parallel overlying air ducts 36, 37. The terminal end 34*a* of the baffle 34 is disposed in spaced-apart relationship with the enclosure end wall 32 to define an opening 38 for communicating the air ducts 36, 37.

The enclosure 28 is provided with an air inlet 39 through which outside air is introduced into the air duct 36 so that such air flows sequentially in the direction of the arrows through the air duct 36, the opening 38 and in the opposite direction through the air duct 37. The enclosure 28 is also provided with an air outlet 41 through which air is discharged from the enclosure 28 both the air inlet 39 and air outlet 41 being disposed opposite the end wall 32 of the enclosure 28.

The air outlet 41 in the enclosure 28 is arranged to communicate by means of a duct 42 with the intake manifold 43 (shown schematically) of the internal combustion engine and a valve 44 is provided in the duct 42 which is movable between the open solid line position FIG. 1 and a closed broken line position in engagement with a sealing means 46. As shown in FIG. 1, the sealing means 46 include a pair of oppositely disposed arcuate seals 46*a*, 46*b* against which the valve 44, preferably a butterfly valve, seals in the closed position of the valve 44.

Heating means are provided for the air introduced into the enclosure 28 through the air inlet 39. More specifically, a burner 47 is suitably supported on the tank 11 by means such as a bracket 48 adjacent the air inlet 39 and is arranged to be fueled from a suitable associated source of fuel such as liquified propane gas of any well known construction.

In the operation of the invention, when it is desired to start the internal combustion engine with which the heater H is associated, the burner 47 is ignited to introduce burning fuel into the air duct 36 thereby heating outside air introduced into the air duct 36 through the air inlet 39. The heated air flowing through the enclosure 28 transfers heat to the coolant in the interior of the tank 17 raising the temperature of the liquid coolant so that heated liquid coolant flows naturally through hose 22 to the engine block and back through hose 21 to the interior 17 of the tank 17 thereby providing heated liquid coolant to the engine block. The heated air discharged from the air duct 37 through the air outlet 41 flows through the duct 42 and valve 44 which prior to engine starting is maintained in the open position thereby providing heated air to the intake manifold raising the temperature of the intake manifold system. It has been found that operation of the heater H for approximately twenty minutes provides the necessary heating of the liquid coolant and the intake manifold system to provide easy starting. At the time the engine is ready to be started, it is necessary to close the valve 44 and by a suitable switching device 50 operatively connected to the valve 44, the starting of the engine moves the butterfly valve 44 into the dotted line closed position thereby engaging sealing means 46 and disconnecting the heater H from the intake manifold of the internal combustion engine.

What is claimed is:

1. A heating device for an internal combustion engine having an intake manifold and a block adapted for circulation of a liquid coolant therein comprising, in combination, a tank having an interior and a liquid inlet and a liquid outlet communicating with said interior, conduit means for connecting said tank inlet and outlet to said engine block for circulation of liquid coolant between said tank and said block, an enclosure having an interior disposed within said tank in sealed relationship therewith, said enclosure being arranged in spaced relationship with said tank to define a liquid chamber substantially surrounding said enclosure in heat transfer relationship therewith, an air inlet in said enclosure for introducing outside air into said enclosure interior and an air outlet for discharging air from said enclosure interior, means for heating the air introduced into said enclosure interior whereby heat is transferred from heated air flowing in said enclosure to said liquid in said liquid chamber thereby supplying heated coolant to said engine block, duct means for connecting said enclosure air outlet to said intake manifold to heat said intake manifold with said heated air from said enclosure, including a valve in said duct means, movable between a closed position and an open position, said valve being normally maintained in the open position during the operation of said heating device and means responsive to the starting of said internal combustion engine for moving said valve into said closed position said duct means and said valve being arranged so that when said valve is in a closed position in said duct means communication thereof with said intake manifold is completely interrupted, said valve entirely closing said duct.

2. A heating device in accordance with claim 1 wherein said enclosure includes an end wall opposite said air inlet and air outlet, a baffle disposed centrally within said enclosure for longitudinally dividing said enclosure interior into a pair of substantially parallel air ducts, said baffle having a terminal end disposed in spaced-apart relationship with said enclosure end wall to define an opening for communication between said air ducts whereby air introduced into said enclosure interior is directed sequentially through one of said air ducts, said opening and the other of said air ducts.

3. A heating device in accordance with claim 2 wherein said tank is circular in cross section and includes a side wall and a pair of end walls, said enclosure air inlet and air outlet being disposed adjacent one of said tank end walls and wherein said opening in said enclosure interior is disposed adjacent the other of said tank end walls, said tank inlet and outlet being disposed in said tank other wall in diametrically opposed relationship.

4. A heating device in accordance with claim 3 including a check valve in said conduit means connected to said tank inlet for blocking the flow of liquid coolant out of said tank and wherein the flow cross section of said tank outlet is less than the flow cross section of said tank inlet.

5. A heating device in accordance with claim 4 wherein said heating means comprises a liquified propane gas burner connected to an associated source of liquified propane gas and means for supporting said burner on said tank one end wall adjacent said air inlet.

6. A heating device in accordance with claim 5 wherein said enclosure is of circular cross-sectional shape and is disposed within said tank interior in coaxial relationship with said tank and wherein said baffle is of substantially planar shape extending diametrically within said enclosure interior to define said pair of air ducts.

7. A heating device in accordance with claim 6 wherein said valve comprises a butterfly valve and including sealing means on the interior of said duct means for sealing engagement with said butterfly valve in the closed position of said valve.

8. A heating device in accordance with claim 7 wherein said air outlet is defined by the end of said other air duct adjacent said tank one end wall.

* * * * *